US007708533B2

(12) United States Patent
Deichmann et al.

(10) Patent No.: US 7,708,533 B2
(45) Date of Patent: May 4, 2010

(54) FUEL FEED UNIT

(75) Inventors: Johannes Deichmann, Alheim-Sterkelshausen (DE); Bernd Jaeger, Fritzlar (DE); Christoph Schmidt, Rotenburg (DE)

(73) Assignee: Siemens Aktiengesellschaft, Munich (DE)

( * ) Notice: Subject to any disclaimer, the term of this patent is extended or adjusted under 35 U.S.C. 154(b) by 375 days.

(21) Appl. No.: 10/571,215

(22) PCT Filed: Jul. 28, 2004

(86) PCT No.: PCT/EP2004/051637

§ 371 (c)(1),
(2), (4) Date: Nov. 15, 2006

(87) PCT Pub. No.: WO2005/026555

PCT Pub. Date: Mar. 24, 2005

(65) Prior Publication Data

US 2007/0065318 A1 Mar. 22, 2007

(30) Foreign Application Priority Data

Sep. 9, 2003 (DE) ..... 103 41 840

(51) Int. Cl.
*F04B 35/04* (2006.01)
*F01D 25/26* (2006.01)

(52) U.S. Cl. ..... 417/423.12; 417/423.14; 415/134; 415/135

(58) Field of Classification Search ..... 417/423.14, 417/423.15, 423.8, 423.12; 415/134, 135
See application file for complete search history.

(56) References Cited

U.S. PATENT DOCUMENTS

| | | | | |
|---|---|---|---|---|
| 1,768,313 | A | 6/1930 | Ferguson et al. | |
| 2,678,606 | A * | 5/1954 | Watson | 415/108 |
| 2,764,266 | A * | 9/1956 | Haworth | 403/22 |
| 3,422,766 | A * | 1/1969 | Conibeer | 415/134 |
| 4,216,821 | A * | 8/1980 | Robin | 165/11.1 |
| 4,427,337 | A * | 1/1984 | Dickinson et al. | 415/113 |
| 4,793,766 | A | 12/1988 | Kumata | |
| 4,915,582 | A | 4/1990 | Nishikawa | |
| 5,123,809 | A | 6/1992 | Ito | |
| 5,338,151 | A * | 8/1994 | Kemmner et al. | 415/55.1 |

(Continued)

FOREIGN PATENT DOCUMENTS

CN 1400395 7/2002

(Continued)

OTHER PUBLICATIONS

German translation of Chinese Office Action dated Dec. 14, 2207 issued in corresponding application No. 200480025782.9.

*Primary Examiner*—Charles G Freay
(74) *Attorney, Agent, or Firm*—Cohen Pontani Lieberman & Pavane LLP

(57) ABSTRACT

A fuel pump unit comprising a housing part (4) arranged between an electric motor (2) and a fuel pump (3). The housing part is provided with expansion joints for compensating thermal expansions or swelling of the material of the housing part (4). The gap between the impeller (6) and the housing parts (4, 5) of the fuel pump (3) can be kept constant by virture of the expansion joints, whereby the fuel pump (3) is essentially prevented from jamming especially when it runs dry.

10 Claims, 1 Drawing Sheet

U.S. PATENT DOCUMENTS

| | | | | |
|---|---|---|---|---|
| 5,375,970 | A * | 12/1994 | Iwai et al. | 415/55.1 |
| 6,402,460 | B1 * | 6/2002 | Fischer et al. | 415/55.1 |
| 6,743,001 | B2 * | 6/2004 | Iwanari et al. | 417/423.7 |
| 2002/0095935 | A1 * | 7/2002 | Kapich | 60/599 |
| 2003/0026717 | A1 | 2/2003 | Iwanari et al. | |
| 2004/0247467 | A1 * | 12/2004 | Ito et al. | 417/423.1 |

FOREIGN PATENT DOCUMENTS

| | | | |
|---|---|---|---|
| CN | 2530066 | | 1/2003 |
| DE | 24 05 112 | A1 | 8/1975 |
| DE | 31 30 288 | A1 | 2/1983 |
| DE | 89 09 458 | | 11/1990 |
| DE | 89 09 458.1 | | 1/1991 |
| DE | 44 28 254 | A1 | 2/1996 |
| EP | 0 994 259 | A1 | 4/2000 |
| EP | 1 088 994 | A1 | 4/2001 |
| JP | 63-126587 | | 5/1988 |
| JP | 63-223388 | | 9/1988 |
| JP | 5-195961 | | 8/1993 |
| JP | 7-27031 | | 1/1995 |

* cited by examiner

FUEL FEED UNIT

BACKGROUND OF THE INVENTION

The invention relates to a fuel feed unit for a motor vehicle having a fuel pump which is driven by an electric motor, and having a rotor of the fuel pump arranged between two housing parts, the rotor being fastened in a rotationally fixed manner to a shaft of the electric motor.

Fuel feed units of this type are frequently used in modern-day motor vehicles and are known from practice. The housing parts of the fuel pump are produced mainly from metal or a sintered ceramic, or have a sintered bush, which is pressed into plastic, as a bearing for the shaft. The housing parts are separated from the rotor by a particularly small clearance and thus form a gap seal of the fuel pump. Heat input as a result of friction or heat from the electric motor leads, however, to the housing parts and the rotor expanding, and thus to a reduction in the gap between the housing parts and the rotor. As a result, further friction occurs in the fuel pump which, in the worst case, causes the later to become jammed. The fuel pump seizes after a very short time in particular during dry running of the fuel feed unit.

The problem on which the invention is based is that of developing a fuel feed unit of the type mentioned in the introduction in such a way that the fuel pump is largely prevented from seizing, in particular during dry running.

BRIEF DESCRIPTION OF THE INVENTION

The problem is solved according to the invention in that at least one of the housing parts has an expansion joint.

This embodiment allows the housing part to expand in the event of heat input or friction. The change in shape of the housing parts can be absorbed by means of corresponding arrangement of the expansion joint or of a plurality of expansion joints and can thus be kept away from the mounting of the shaft and from the rotor. The gap seal between the housing parts and the rotor can be kept largely constant by means of the invention even in the event of thermal expansion of the housing parts. As a result, the generation of further friction is kept particularly low, and the fuel pump is largely prevented from seizing. The fuel feed unit according to the invention can therefore be operated in a dry state and thus without fuel for a particularly long period of time without the fuel pump seizing.

The fuel feed unit according to the invention can be produced in a particularly cost-effective manner if at least one of the housing parts is produced from plastic and if the plastic forms a bearing shell for directly mounting the shaft. In known fuel feed units for gasoline fuels, the housing parts, including the bearing for the shaft, could not be produced entirely from plastic since a change in shape as a result of swelling of the plastic on contact with fuel, in addition to that caused by the heat input from the electric motor, prevents the housing parts from being sealed off with respect to the rotor. The expansion joints according to the invention absorb the change in shape of the plastic as a result of swelling and thus prevent the gap seal with respect to the rotor and a bearing gap with respect to the shaft from being altered. A further advantage of the use of plastic as a housing part is that heat generated by the electric motor is particularly badly conducted. This leads to a further reduction of friction in the fuel pump.

According to another advantageous refinement of the invention, changes in shape occurring in both the axial and radial directions can be easily compensated for by means of corresponding arrangement of the expansion joints if the housing part which faces toward the electric motor has a radial section which runs toward the shaft and an axial section which leads away from the rotor parallel to the shaft.

According to another advantageous refinement of the invention, heat input into the housing part which faces the electric motor can be kept particularly low if the expansion joint is arranged on the axial section near the rotor and is embodied as a spacing of the housing part from the shaft.

According to another advantageous refinement of the invention, friction in the region of the bearing of the shaft can be further reduced if the expansion joint runs over approximately half of the axial section.

According to another advantageous refinement of the invention, friction in the region of the bearing of the shaft can be further reduced if the expansion joint on the axial section runs over the entire height of the radial section. The radial section of the housing part which faces toward the electric motor can as a result expand in its plane without leading to increased friction in the bearing of the shaft.

According to another advantageous refinement of the invention, deformation of one of the sections as a result of a change in shape of the other section can be easily avoided if the expansion joint is arranged in the corner region at which the two sections adjoin one another.

According to another advantageous refinement of the invention, interference in the gap seal between the housing parts and the rotor can be easily prevented if the expansion joint is arranged on that side of the housing part facing toward the electric motor which faces away from the rotor.

According to another advantageous refinement of the invention, the housing part which faces toward the electric motor can be produced in a particularly cost-effective manner in an injection mold, from which the molding can be removed axially, if the expansion joint is embodied as a groove which runs all the way around the axial section.

The production costs of the fuel feed unit according to the invention can be further reduced if the axial section and the radial section are produced in one piece.

BRIEF DESCRIPTION OF THE DRAWINGS

The invention permits a large number of embodiments. In order to further clarify its basic principle, one of them is described in the following and is illustrated in the drawing, in which.

DETAILED DESCRIPTION OF THE INVENTION

Figure 1:
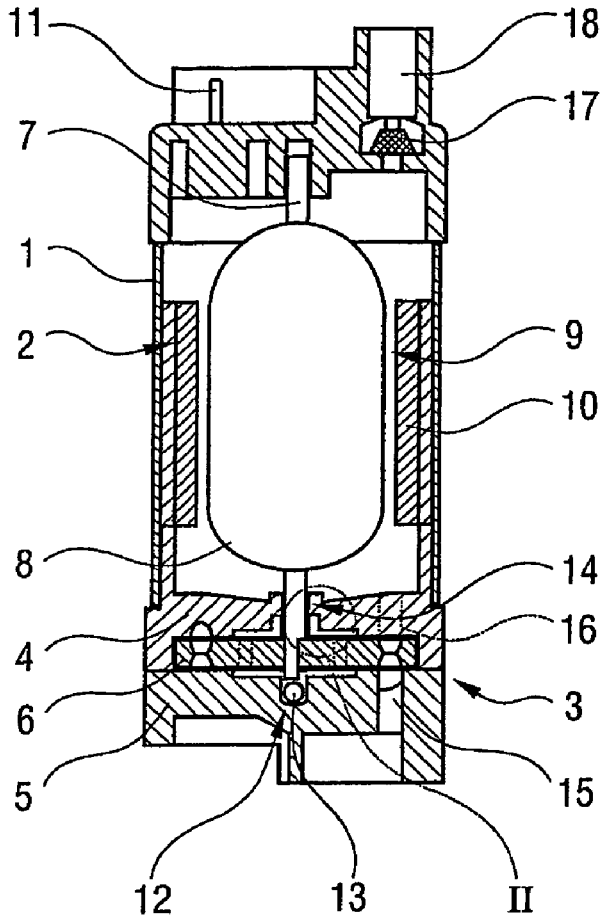
FIG. 1 shows a fuel feed unit according to the invention for a motor vehicle.

FIG. 1 shows a fuel feed unit, intended for arrangement in a fuel tank of a motor vehicle, having a housing 1 and having a fuel pump 3 driven by an electric motor 2. The fuel pump 3 is embodied as a side-channel pump and has a rotor 6 which is rotatably arranged between two housing parts 4, 5. The rotor 6 is fastened to a shaft 7 of the electric motor 2. The electric motor 2 has a rotor 9, which includes coils 8 and the shaft 7, and a stator 10, with magnetic shells, which is connected to the housing 1. The electric motor 2 can be supplied with electric current by means of electrical contacts 11 which are arranged on the outside of the housing 1. The feed unit has an axial bearing 12 with a ball 13, which is arranged in the housing part 5 facing away from the electric motor 2 and supports the shaft 7, and a radial bearing 14 in the housing part 4 which faces toward the electric motor 2.

When the rotor 6 is driven, the fuel pump 3 sucks in fuel via a suction duct 15 and feeds said fuel via an outlet duct 16 into the housing 1 of the feed unit. The fuel then flows through the electric motor 2 in a gap between the stator 10 and the rotor 9. For clarity, the fuel flows are indicated by arrows in the drawing. The fuel then flows via a non-return valve 17 to a connecting pipe 18. A fuel line (not illustrated) which is connected to an internal combustion engine of the motor vehicle can be connected to the connecting pipe 18.

Figure 2:
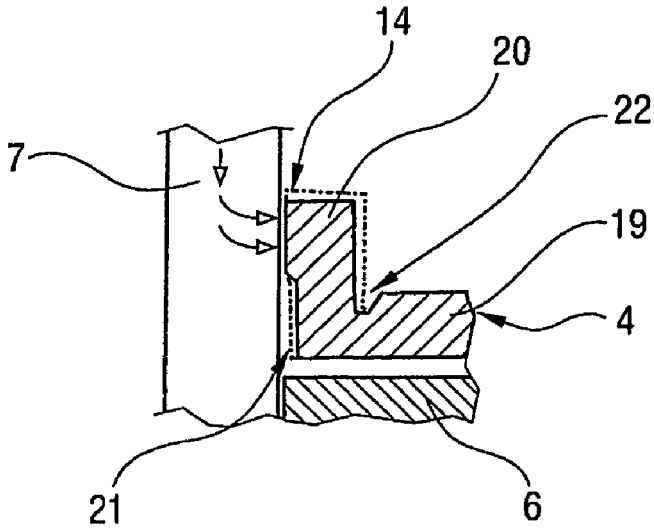
FIG. 2 shows a greatly enlarged illustration of a partial region II of a fuel pump of the feed unit from FIG. 1.

FIG. 2 shows a greatly enlarged view of a partial region of the housing part 4, which is arranged between the rotor 6 and the electric motor 2, in the region of the shaft 7. The housing part 4, which faces toward the electric motor 2, of the fuel pump 3 has a radial section 19 which runs toward the shaft 7, and an axial section 20 which is arranged parallel to the shaft 7. A first expansion joint 21 runs, adjacent to the shaft 7, over half of the axial section 20 from the rotor 6. The radial bearing 14 of the shaft 7 is arranged on the second half of the axial section 20. A second expansion joint 22 is embodied as a groove which is arranged in the radial section 19 and runs continuously around the axial section 20.

During dry running, and thus when fuel is not being fed, heat generated by the electric motor 2 is introduced into the fuel pump 3 via that region of the axial section 20 which is embodied as a radial bearing 14. Only an insignificant amount of heat can be transmitted to the fuel pump 3 in the expansion joint 21 of the axial section 20, since the housing part 4 is at a distance from the shaft 7 here. For clarity, the flow of heat is indicated in the drawing by arrows. The heat can lead to expansion of the axial section 20 in the radial direction. During dry running, and thus when fuel is not being fed, friction heat generated by the fuel pump 3 leads to expansion of the radial section 19 in a direction toward the shaft 7. The radial section 19 can expand, by means of the two expansion joints 21, 22, a small amount in the direction of the shaft 7 without introducing forces into the radial bearing 14. For clarity, expansions of the housing part 4, which is arranged between the fuel pump 3 and the electric motor 2 from FIG. 1, which result from a temperature increase are illustrated by a dash-dotted line in the drawing.

The invention has been illustrated by way of example on a side-channel pump. The fuel pump 3 can of course also be a peripheral pump or a positive displacement pump such as a so-called G-rotor pump.

The invention claimed is:

1. A fuel feed unit for a motor vehicle, comprising:

a fuel pump which is driven by an electric motor;

a first housing part and a second housing part; and a rotor arranged between the first and second housing parts, the rotor of the fuel pump being fastened in a rotationally fixed manner to a shaft of the electric motor;

wherein at least one of the first and second housing parts forms a bearing shell for directly mounting the shaft and forms an expansion joint which is configured to expand due to heat generated by the fuel feed unit.

2. The fuel feed unit as claimed in claim 1, wherein at least one of the first and second housing parts is produced from plastic.

3. The fuel feed unit as claimed in claim 1, wherein the first housing part faces toward the electric motor includes a radial section which extends toward the shaft of the electric motor and includes an axial section which extends away from the rotor in a direction parallel to the shaft.

4. The fuel feed unit as claimed in claim 3, wherein the expansion joint is arranged on the axial section near the rotor and comprises a spacing of the first housing part from the shaft of the electric motor.

5. The fuel feed unit as claimed in claim 3, wherein the expansion joint extends over approximately half of the axial section.

6. The fuel feed unit as claimed in claim 3, wherein the expansion joint on the axial section extends over an entire height of the radial section.

7. The fuel feed unit as claimed in claim 3, wherein the expansion joint is arranged in a corner region at which the axial and radial sections adjoin one another.

8. The fuel feed unit as claimed in claim 3, wherein the expansion joint is arranged on a side of the first housing part facing toward the electric motor which faces away from the rotor.

9. The fuel feed unit as claimed in claim 3, wherein the expansion joint comprises a groove which extends around an entire circumference of the axial section.

10. The fuel feed unit as claimed in claim 3, wherein the axial section and the radial section are produced in one piece.

* * * * *